US006377227B1

(12) United States Patent
Zhu et al.

(10) Patent No.: US 6,377,227 B1
(45) Date of Patent: Apr. 23, 2002

(54) HIGH EFFICIENCY FEED NETWORK FOR ANTENNAS

(75) Inventors: Luke Zhu; Yuning Guo; Xifan Chen, all of Ontario (CA)

(73) Assignee: SuperPass Company Inc., Waterloo (CA)

( * ) Notice: Subject to any disclaimer, the term of this patent is extended or adjusted under 35 U.S.C. 154(b) by 0 days.

(21) Appl. No.: 09/559,530

(22) Filed: Apr. 28, 2000

(30) Foreign Application Priority Data

Apr. 28, 1999 (CA) ..... 2270302

(51) Int. Cl.[7] ..... H01Q 9/28

(52) U.S. Cl. ..... 343/795; 343/700 MS

(58) Field of Search ..... 343/700 MS, 795, 343/853, 860

(56) References Cited

U.S. PATENT DOCUMENTS

| | | | | | |
|---|---|---|---|---|---|
| 3,887,925 | A | * | 6/1975 | Ranghelli et al. | 343/795 |
| 3,971,125 | A | | 7/1976 | Thies, Jr. | 343/769 |
| 5,293,175 | A | * | 3/1994 | Hemmie et al. | 343/795 |
| 5,387,919 | A | | 2/1995 | Lam et al. | 343/821 |
| 5,596,336 | A | * | 1/1997 | Liu | 343/770 |
| 5,598,174 | A | | 1/1997 | Erkocevic et al. | 343/795 |
| 5,661,494 | A | * | 8/1997 | Bondyopadhyay | 343/700 MS |
| 5,754,145 | A | | 5/1998 | Evans | 343/795 |
| 6,014,112 | A | * | 1/2000 | Kocica et al. | 343/795 |
| 6,166,702 | A | * | 12/2000 | Audenaerde et al. | 343/795 |

* cited by examiner

*Primary Examiner*—Tan Ho
(74) *Attorney, Agent, or Firm*—Dowell & Dowell, P.C.

(57) ABSTRACT

A printed antenna comprising a dielectric substrate, dipole elements formed on a surface of the substrate, a matching network for coupling a driving point to the antenna elements, whereby common mode currents are minimized thereby minimizing the antenna performance degradation.

12 Claims, 19 Drawing Sheets

55° beamwidth

90° beamwidth

120° beamwidth

180° beamwidth

HIGH EFFICIENCY FEED NETWORK FOR ANTENNAS

The present invention relates to printed antennas, more particularly to printed antenna configurations which improve the efficiency of these antenna.

BACKGROUND OF THE INVENTION

Antennas adopt many forms, each adapted for a particular application of the antenna. Antennas have many commercial and military applications such as cellular telephones and other mobile communications and data links.

One type of antenna is the dipole antenna which comprises a quarter wavelength dipole radiators coupled through a balanced transmission line and a balun to a drive signal source or a receiver. Other types include loop, slotted loops, end loaded and such like.

Various forms of dipole antennas are described for example in U.S. Pat. No. 5,387,919, U.S. Pat. No. 5,598,174, U.S. Pat. No. 5,754,145, while in the U.S. Pat. No. 3,971,125, the methods of making printed antennas using a printed circuit technique is described.

In general, it maybe seen that for dipole antennas, it is desirable to provide an arrangement wherein the feed network does not interfere with the radiation path of the antenna, and in which there is minimal unwanted radiation from the antenna. Furthermore, the antenna should have sufficient bandwidth for many types of applications and should be capable of being mounted for use without the mount interfering substantially with the radiation pattern of the antenna. Also quite importantly, the antenna should be generally inexpensive to fabricate with the capability of withstanding tolerance variations during the manufacture process while still maintaining an adequate radiation pattern.

Furthermore, for printed circuit board based high gain antenna array, a problem is the high loss due to the feed network. Traditionally, to reduce the loss of the feed network, a low loss PCB material is used in the antenna array design. However, low loss PCB material is usually more expensive than the standard FR4 material. For example, a stand FR4 material costs approximately $1.5 U.S. per square foot, but a low loss RF35 material is still about six times higher in price. Thus, it is desirable to provide for printed antennas dielectric material which is inexpensive but at the same time has a minimal effect on the characteristics of the antenna which are desired for a particular application.

The present invention thus seeks to mitigate some of the above disadvantages.

SUMMARY OF THE INVENTION

In accordance with this invention, there is provided a printed antenna comprising a dielectric substrate, dipole elements formed on a surface of the substrate, a matching network for coupling a driving point to the antenna elements, whereby common mode currents are minimized thereby minimizing the antenna performance degradation In accordance with a further embodiment of the invention, there is provided a printed circuit antenna comprising a first substrate having antenna elements formed thereon; a second substrate material having a feed network formed thereon and for coupling a feed to the antenna elements.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
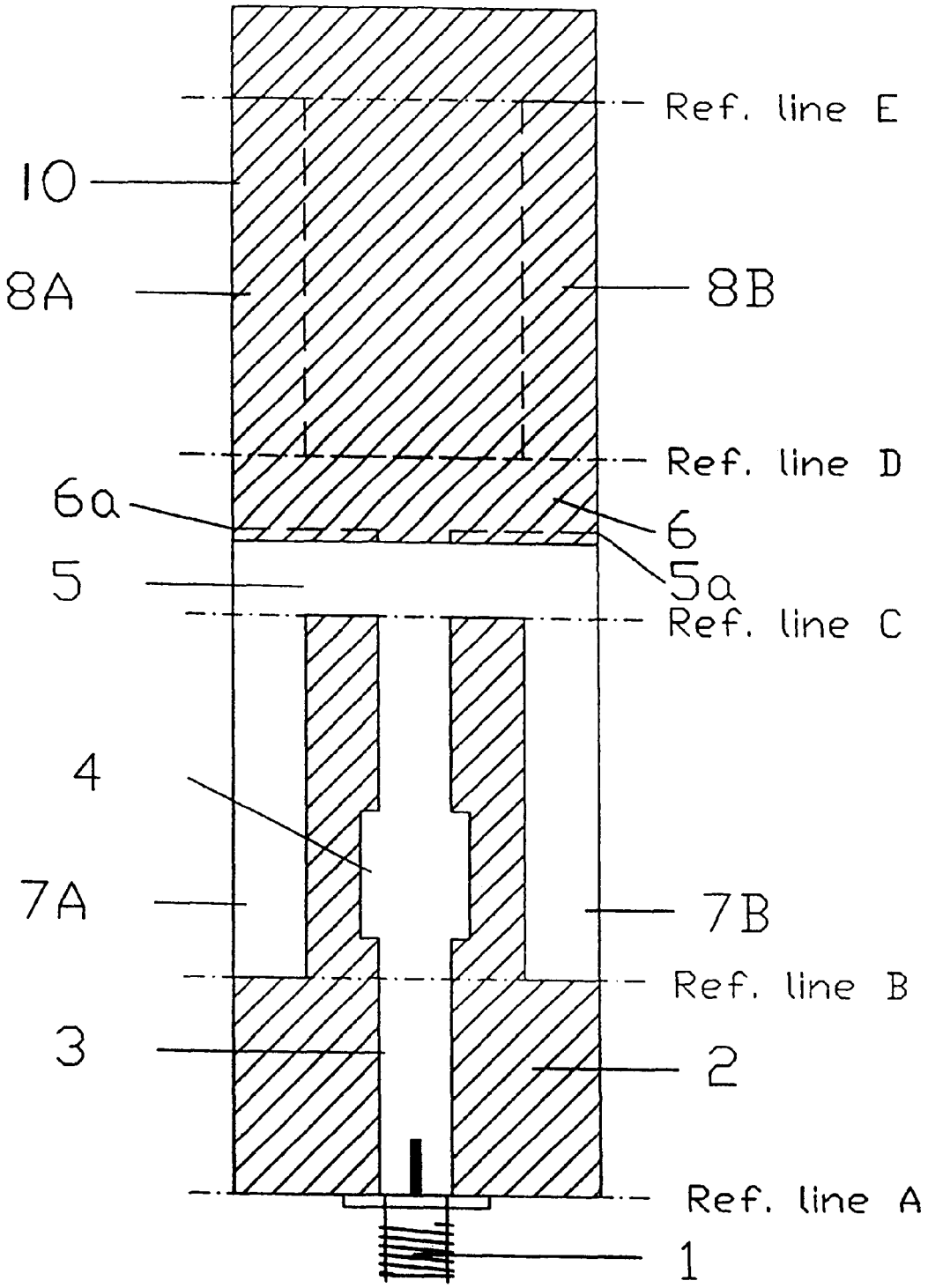
FIG. 1 is a schematic top view of a dipole antenna according to the present invention.

A single element printed dipole antenna (10) according to an embodiment of the present invention, is shown in FIG. 1. The antenna(10) a 50 Ohm connector (1) for coupling an RF signal to or from a printed dipole antenna radiator element The dipoles are formed on opposing surfaces of an FR4 Printed Circuit Board (PCB) (2), the dipole element antenna are etched on both sides of the PCB. The elements are generally U-shaped, with the leg portion of the U extending in opposite directions.

A pair of printed strips (3), extending from the feed (1) at a reference line (A) and ending at a reference line (C), are etched on both sides of the PCB with the same width. The paired strips are designed to act both as a matching network and a transmission line to deliver or receive the RF signal to or from radiation elements.

A small patch (4), etched on one or both sides of the PCB, forms part of the matching network (3). Its size may be varied to best tune the Voltage Standing Wave Ratio (VSWR) looking into the 50 Ohm connector from the reference line (A).

The base of the U for each of the dipole elements is formed by first strip (5) and a second strip (6) respectively, between reference lines (C) and (D). The first or second strips are connected to respective top and bottom matching strips (3). The first and second strips (5) and (6) do not line up, but offset their position toward both top and bottom directions have a narrow gap between their lower edges 5(*a*) and 6(*a*) to provide another form of a feeding (matching network.

The upper dipole element has formed by two strips (7A) and (7B) between a reference line () and the reference line (C) and are connected to the strip (5). They each constitute radiation components and are approximately quarter wavelength long and have appropriate width. Both elements (7A) and (7B), as well as the paired strips (3) also form a coplanar wave guide of quarter wavelength for common mode current. Since is coplanar wave-guide is shorted at the top end (i.e., at the reference line (C)), the impedance looking into its bottom end (i.e., at the reference line (B) is very high and behaviour like a common mode choke. Therefore, this antenna has no common mode current starting from the reference line (13) towards the connector direction.

For the lower dipole element, two strips (8A) and (8B) between the reference line (D) and a reference line (E) are connected to the second strip (6). They also constitute radiation components. They are approximately quarter wavelength long and have the same width as the strip (7A) and (7B).

Figure 2A:
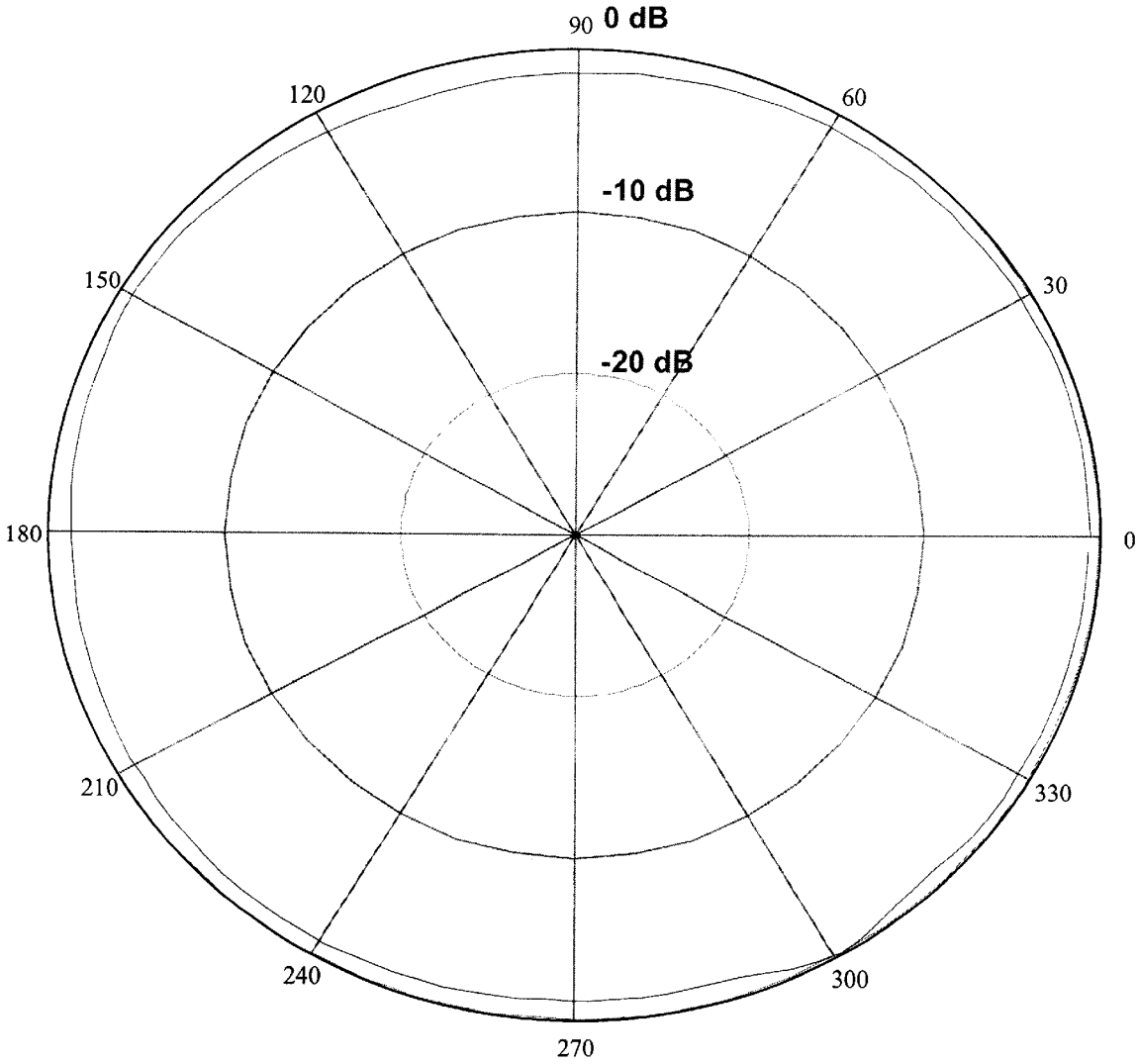
FIGS. 2(*a*) and 2(*b*) are respective H-plane and E-plane radiation patterns for the antenna of FIG. 1.
Figure 2B:
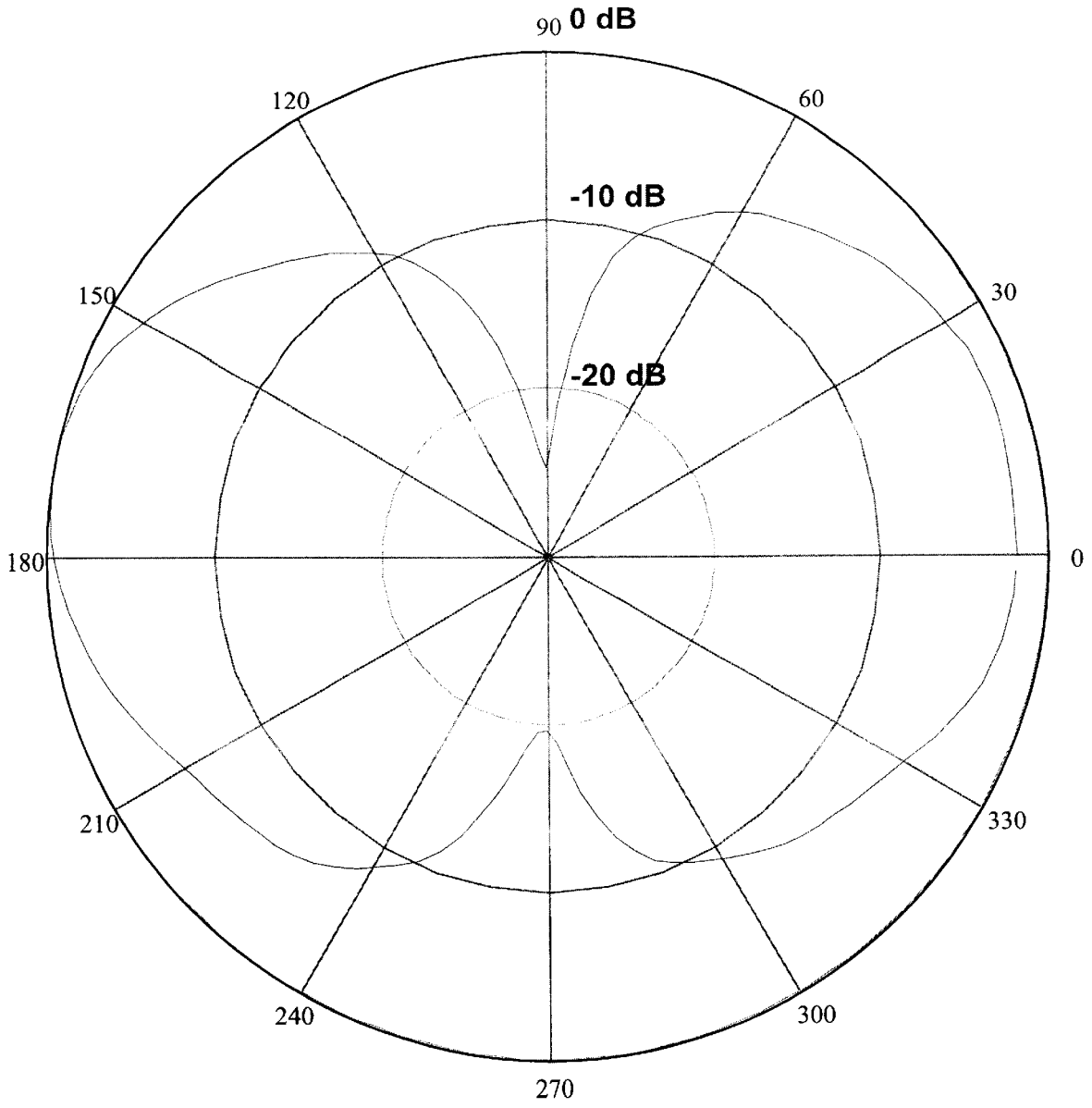

Both (7A) and (8A) form a printed dipole antenna on the left side of the antenna, so do the (7B) and (8B) on the right side of the antenna. Since both printed dipole antennas are to very close to each other, they can be looked at as a single dipole from the far field. Its typical H-plane and E-plane radiation patterns are shown in FIG. 2 with maximum gain being about 2.5 dBi.

Figure 3:
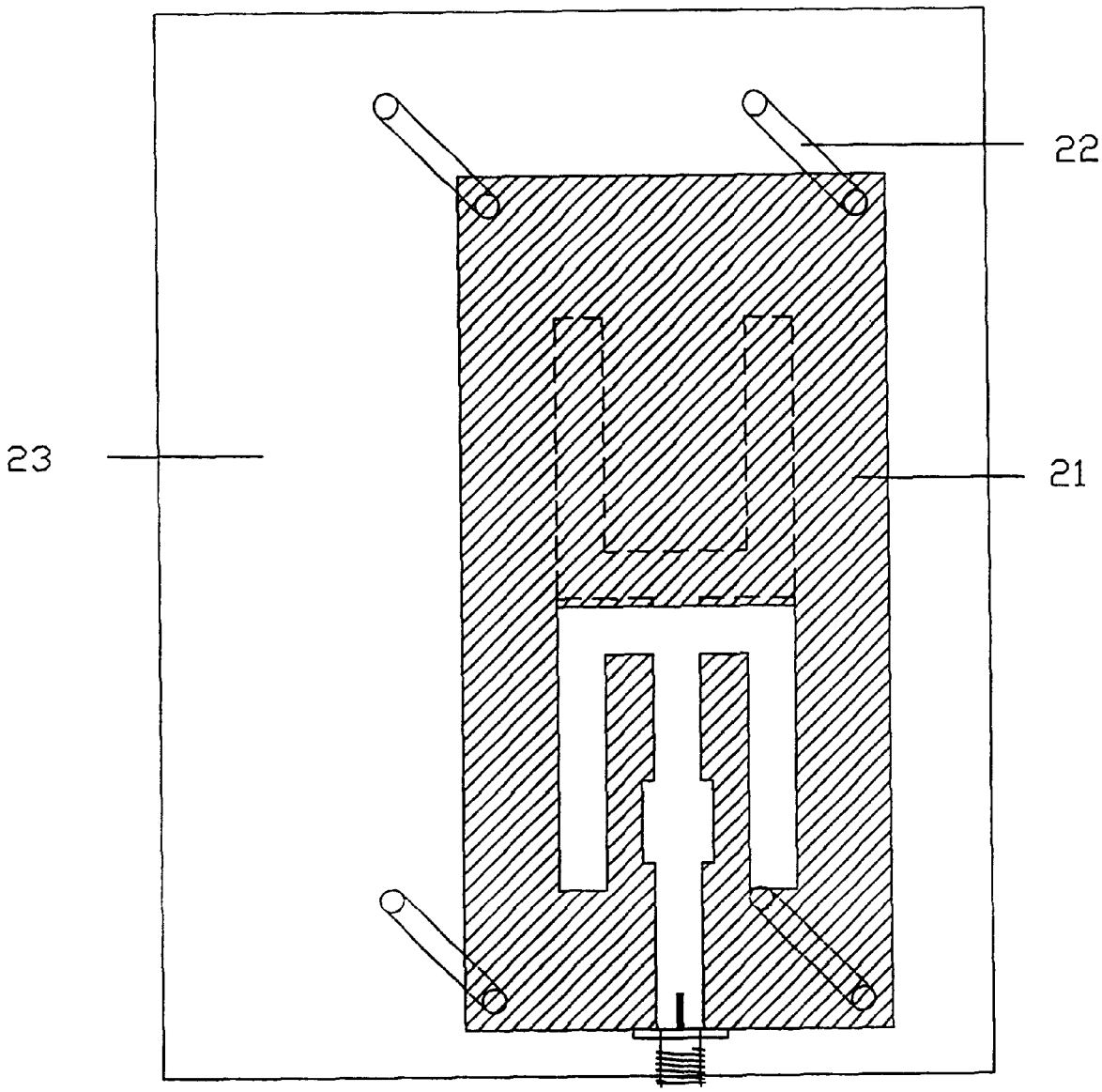
FIG. 3 is a further embodiment of a dipole antenna according to the present invention.

The same printed dipole antenna as in FIG. 1 can be used to form a direction panel antenna as shown in FIG. 3.

Figure 4A:
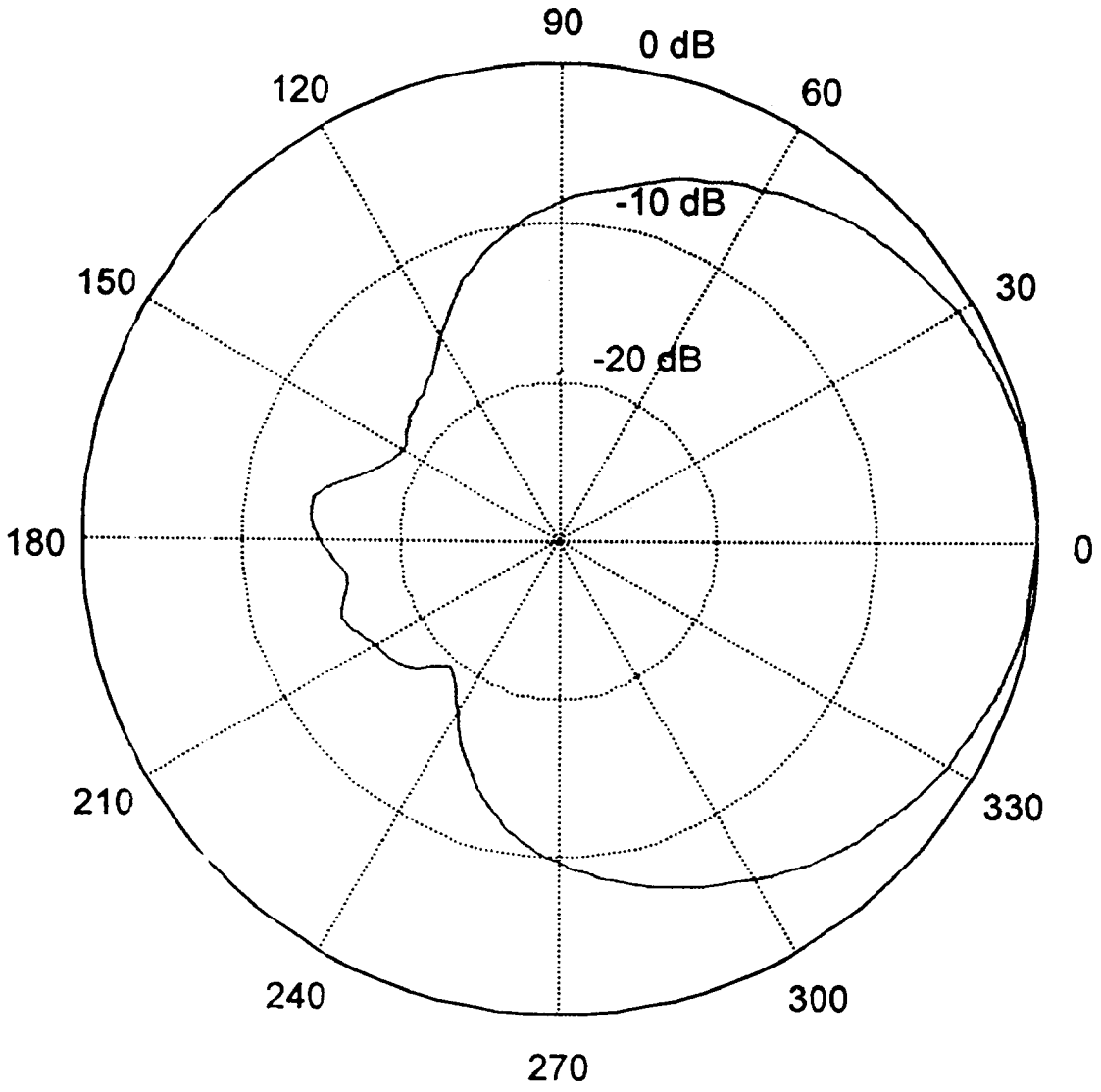
FIGS. 4(*a*) and 4(*b*) are respective H-plane and E-plane radiation patterns of the antenna in FIG. 3.
Figure 4B:
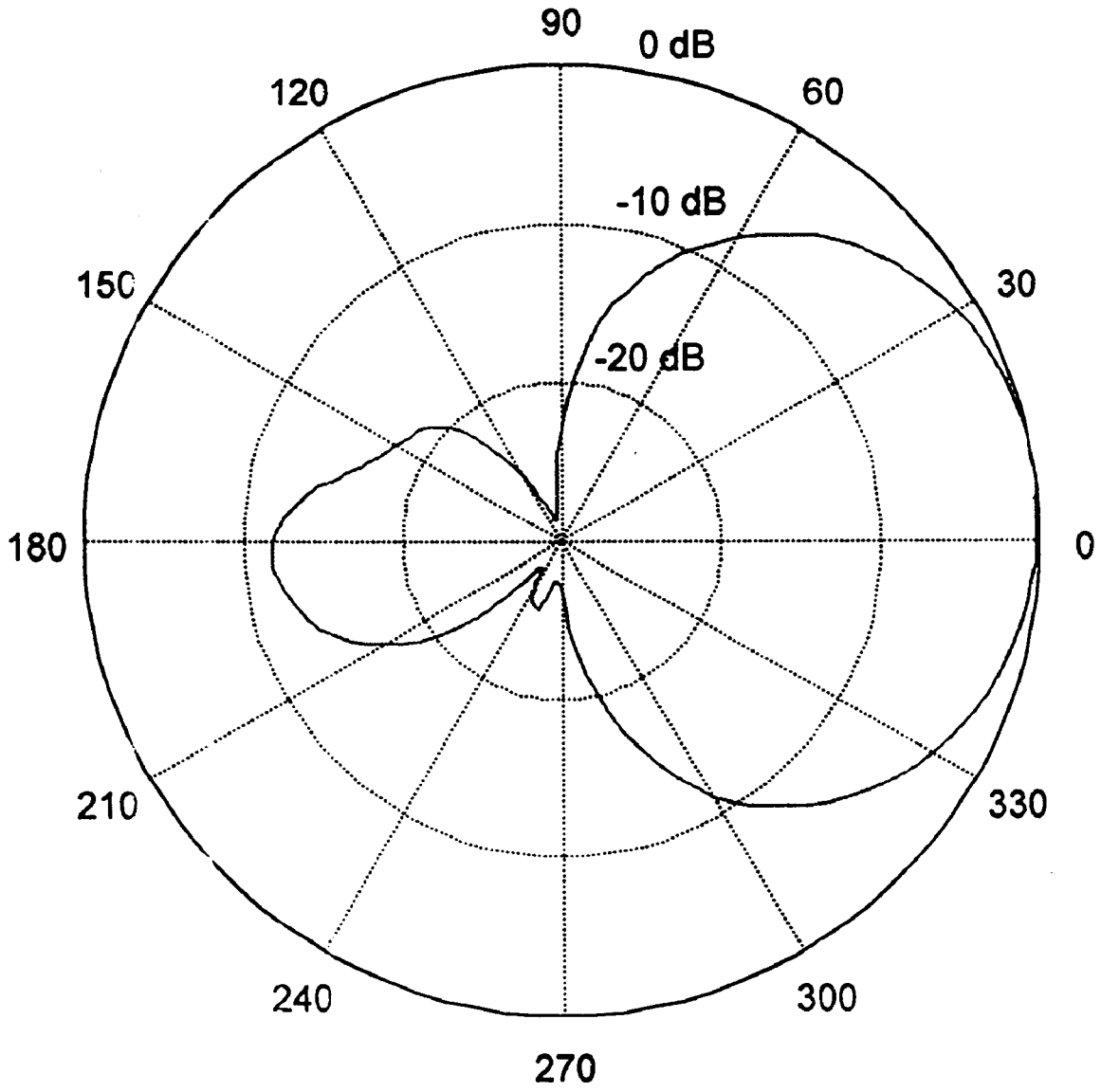

The same printed dipole antenna architecture is employed and slight wide PCB (21) is used, so that four Nylon spacers (22) can be attached to it to provide appropriate space between the printed dipole antenna and a metal reflector (23). With this configuration, direction radiation patterns on both H- and E-planes are obtained as shown in FIG. 4 with maximum gain being about 7 dBi.

Figure 5:
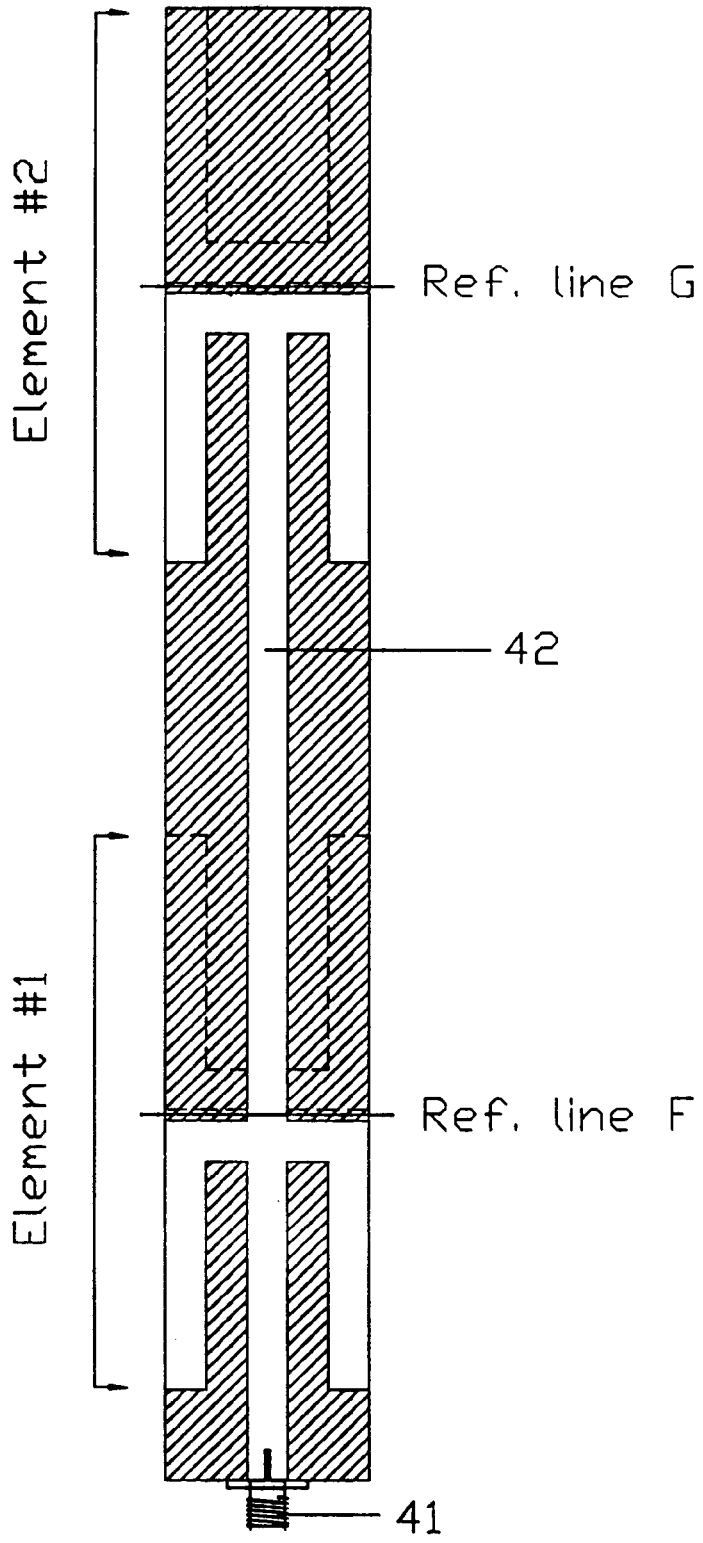
FIG. 5 is a schematic diagram of a dipole antenna array according to a further embodiment of the present invention.

Two elements printed dipole antenna is shown in FIG. 5. Detailed explanations of each portion of the antenna are given as follows.

Figure 6A:
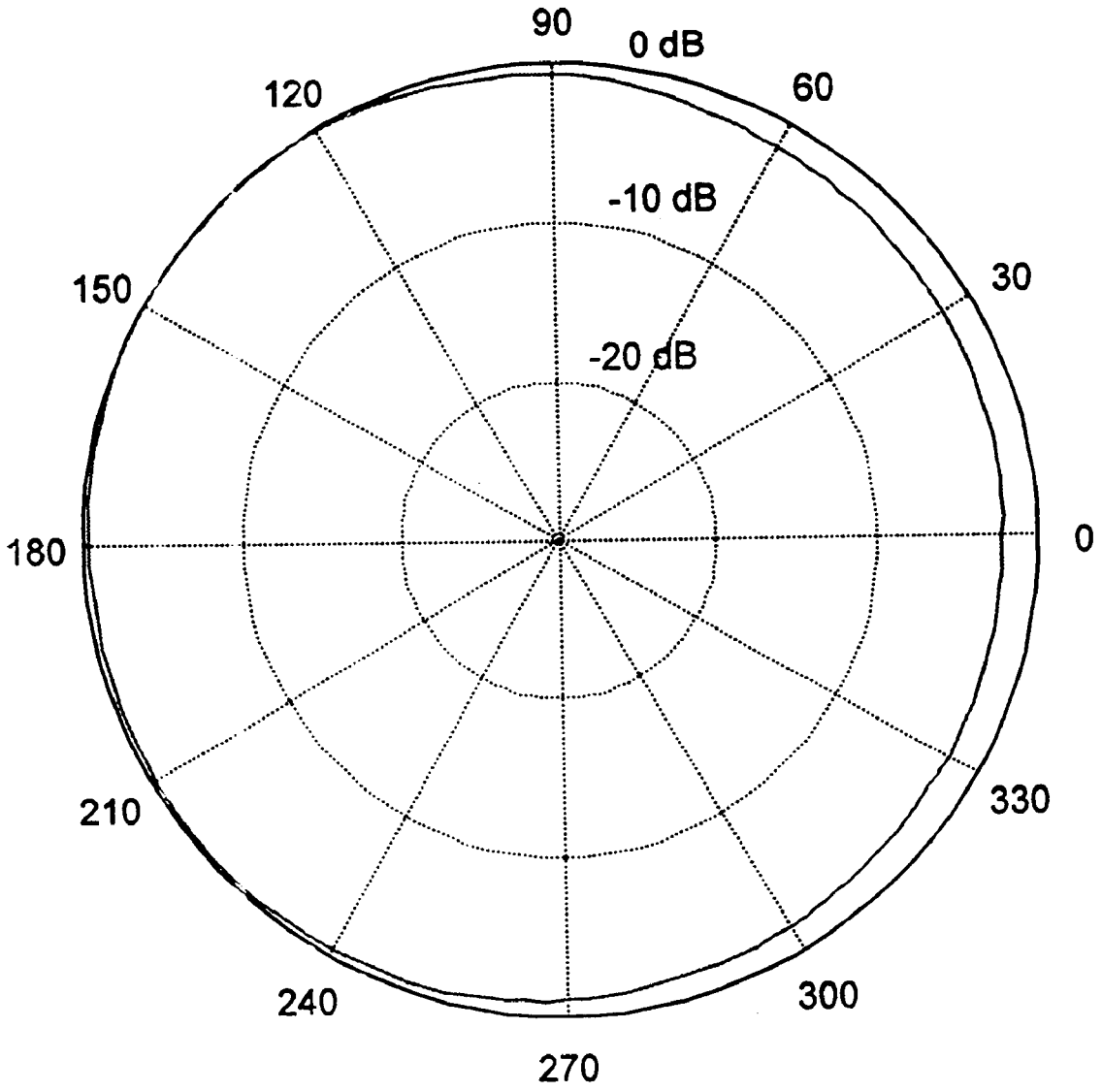
FIGS. 6(*a*) and 6(*b*) are respective H-plane radiation patterns of the antenna in FIG. 5, and FIG. 7(*a*) and 7(*b*) is a schematic diagram showing a plan and side view respectively of a center feed four element antenna according to a further embodiment of the present invention.
Figure 6B:
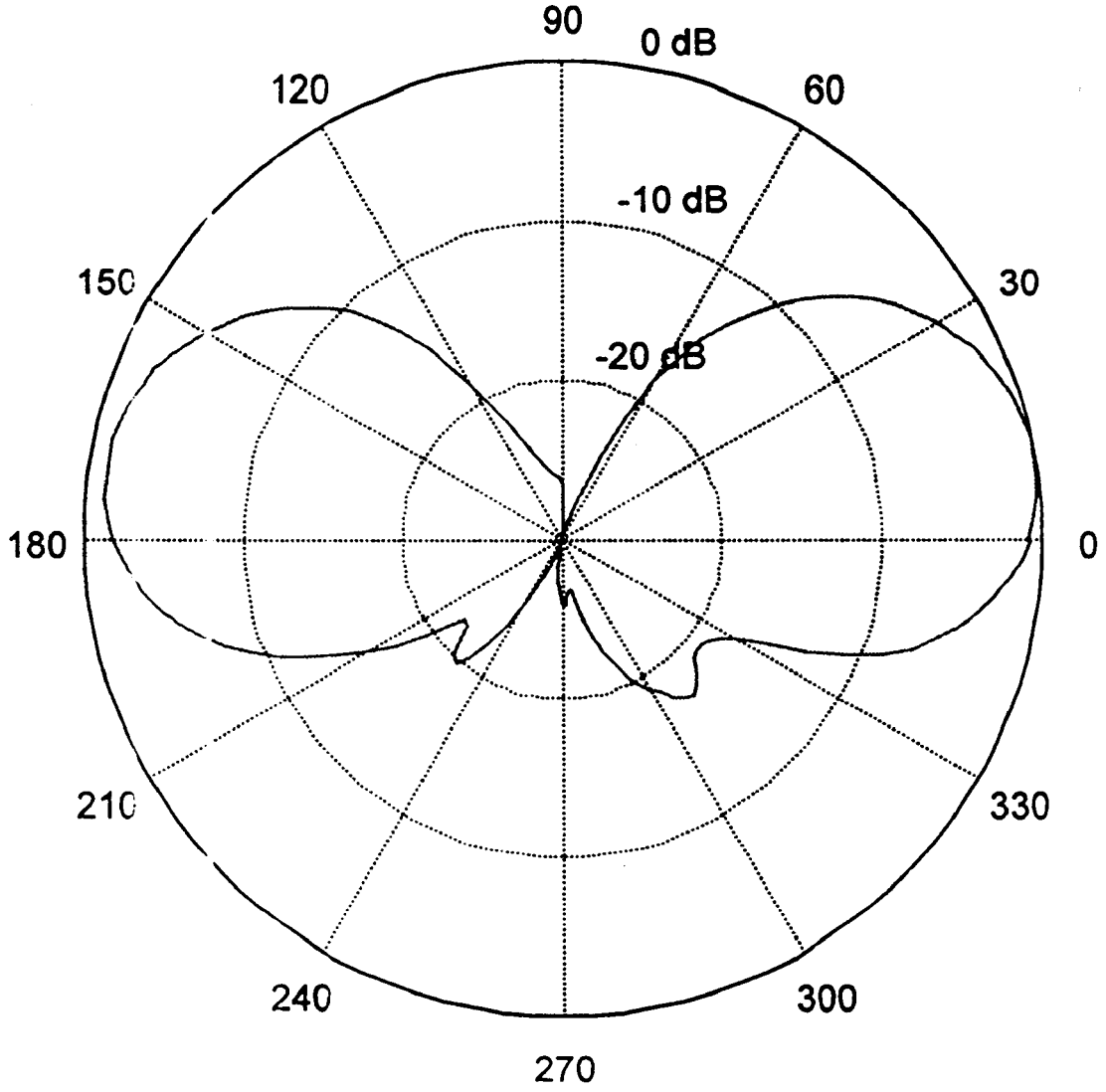

Element 1 and 2 are two printed dipole antennas, similar to that as explained in FIG. 1. An U signal is delivered to or received from the element 1 via a 50 Ohm connector (41). The part of he RF signal is further delivered to or received from the element 2 through paired strips (42), starting from a reference line (F) and ending at a reference line (G), is etched on both sides of the PCB with the same width. The paired strips are designed to provide appropriate matching and phase shift, so that the RF signal delivered to both elements will be approximately the same amplitude and in-phase. In this case, the maximum antenna gain is increased to about 5 dBi. The antenna's radiation patterns in both H- and E-planes are shown in FIG. 6. Note that the two elements are connected in series fashion.

Figures 7A, 7B:
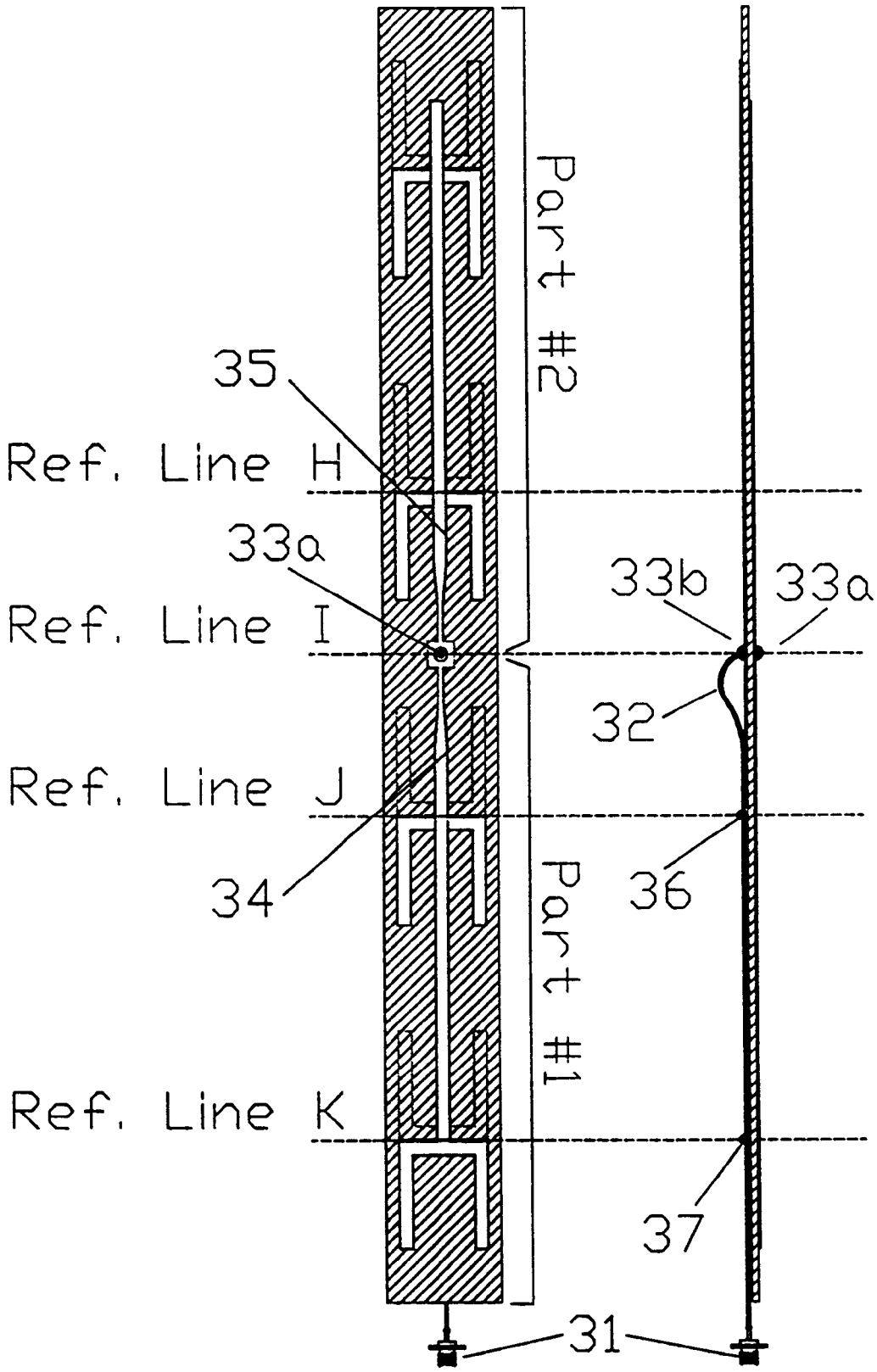

A center feed four elements printed antenna is shown in FIG. 7, according to a further embodiment of the present invention Detailed descriptions of each portion of the antenna is described as follows.

Part #1 and Part #2 in FIG. 7 are very similar to the two elements printed dipole antenna in FIG. 5, where the Part #2 is the mirror of the Part #1 with respect to Ref. Line (I). Both parts share the same feed point (33).

Assume that an RF signal is fed into a 50 ohm connector (31). Then, the signal will travel through a 50 ohm low loss semirigid cable (32) to the feed point (33), where the inner conductor of the cable is soldered to the upper feed point (33*a*) and the outer conductor of the cable to the bottom feed point (33*b*), as shown in FIG. 7(*b*). This coax cable-to-printed strips transition provides a good 50 ohm match for the RF signal. After that, the signal will be equally distributed between the Part #1 and the Part #2. That is, half of the signal energy will go down from the Ref. Line (I) to Ref Line (J) and the other half will go up from the Ref Line (I) to Ref Line (H) via two pairs of printed strips (34) and (35), respectively. Technically, this feed structure is called the parallel feed network. Since the two pairs of the printed strips (34) and (35) are physically the same structure and have the same length, then, the electrical distances throught which the respective halves of the signal have travelled will be exactly the same. Therefore, both the Part #1 and Part #2 are fed with equal signal strength ad same phase. Also, the two pairs of the printed strips provide proper impedance transformation from 50 ohm impedances at the Ref. Lines (H) and (J) to 100 ohm impedances at the Ref. Line (I), respectively. These two 100 ohm impedances are then in parallel to each other and constitutes a 50 ohm impedance at the feed point (33), which matches the 50 ohm semi-rigid cable (32) very well.

If several ideal conditional conditions are met based on well known antenna array theory, such as lossless feed network, optimal spacing, etch, the antenna thus developed will have a theoretical 3 dB more gain than that of the two elements printed dipole antenna as shown in FIG. 5. However, as it is well known that due to the loss of the semi-rigid cable and the loss of the two pain of the feed printed strips, we can not achieve the theoretical extra 3 dB gain. The measured gain of a practically implemented antenna as shown in FIG. 7 is about 2.5 dB over that of the antenna as shown in FIG. 5.

It should be noted that the semi-rigid cable is physically soldered at point (36) and (37) as shown in FIG. 7(*b*) to the bottom side of the pair of printed strips between the Ref. Line (J) and Ref. Line (K). This cable attachment to the printed ships (from the point (36) to the point (37)) has little or invisible affact to both the transmission line function of the strips and the radiation function of the radiation components on both sides of printed strips as shown in FIG. 7(*a*) (similar to the components (7) and (8) of FIG. 1). Therefore, this four elements printed antenna still maintains very good omni-directional radiation pattern as that of the two elements printed antenna.

Figure 8:
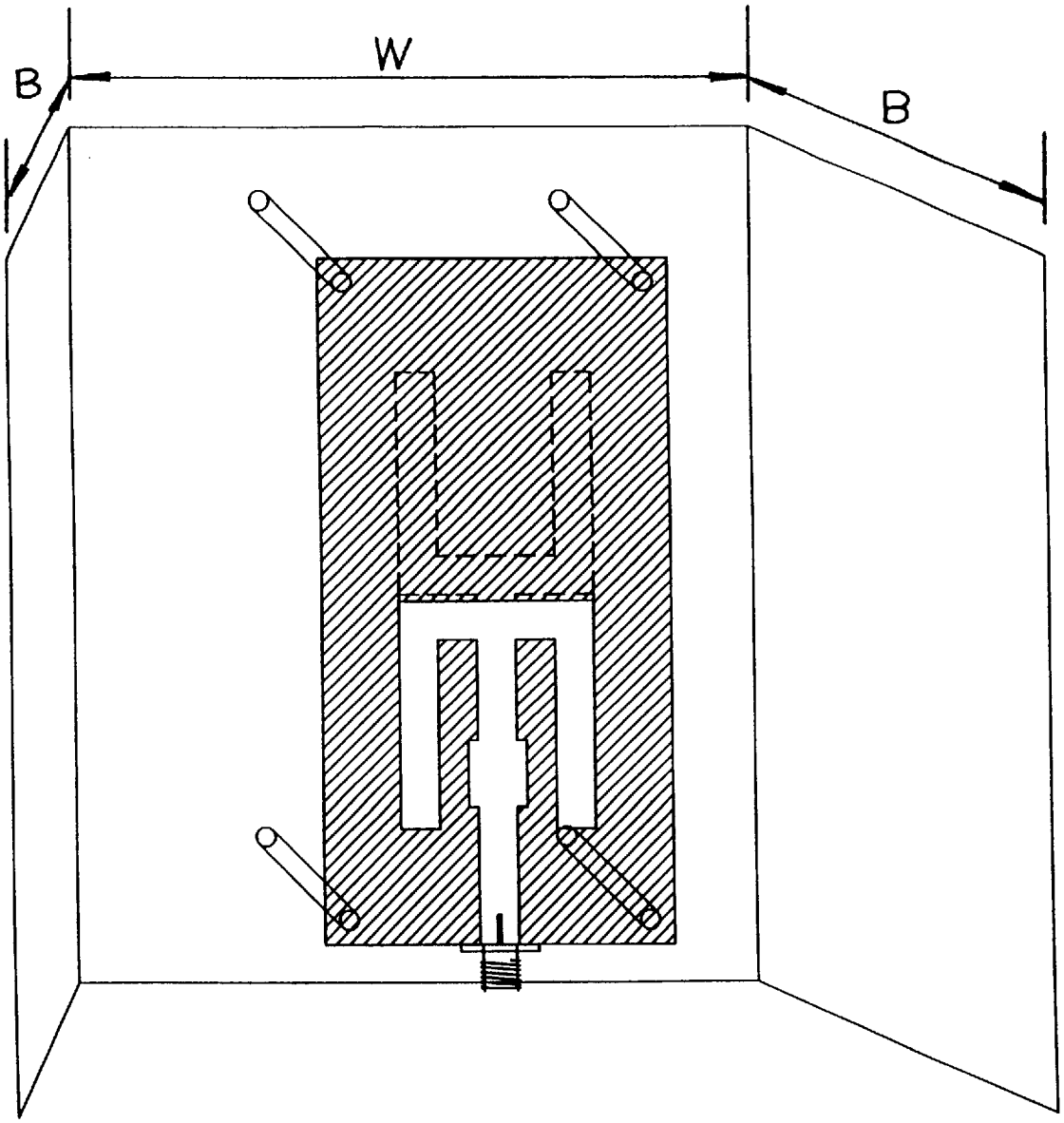
FIG. 8(*a*) to 8(*d*) are four additional embodiments of the dipole antenna based on FIG. 3.
Figure 8:
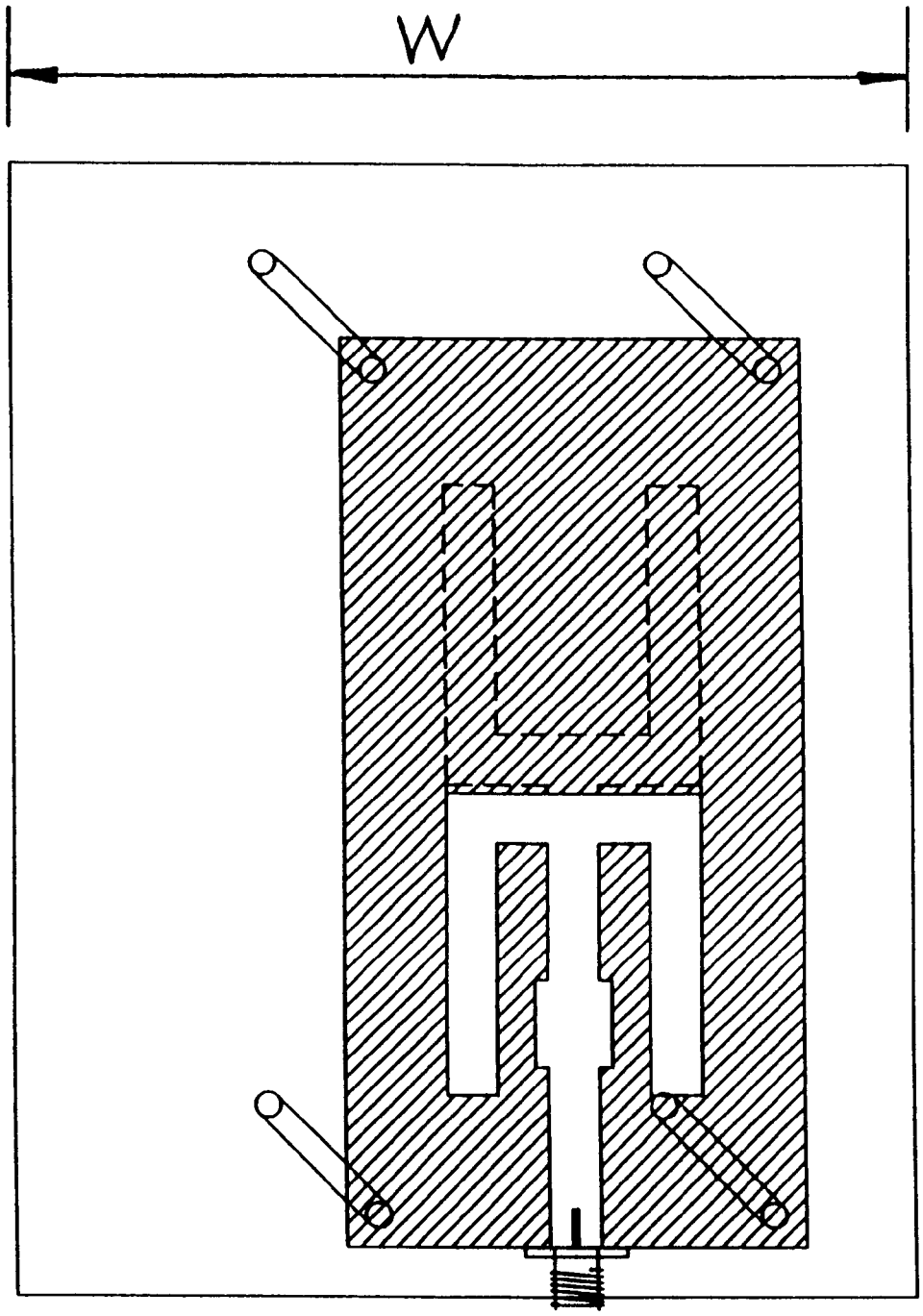
Figure 8:
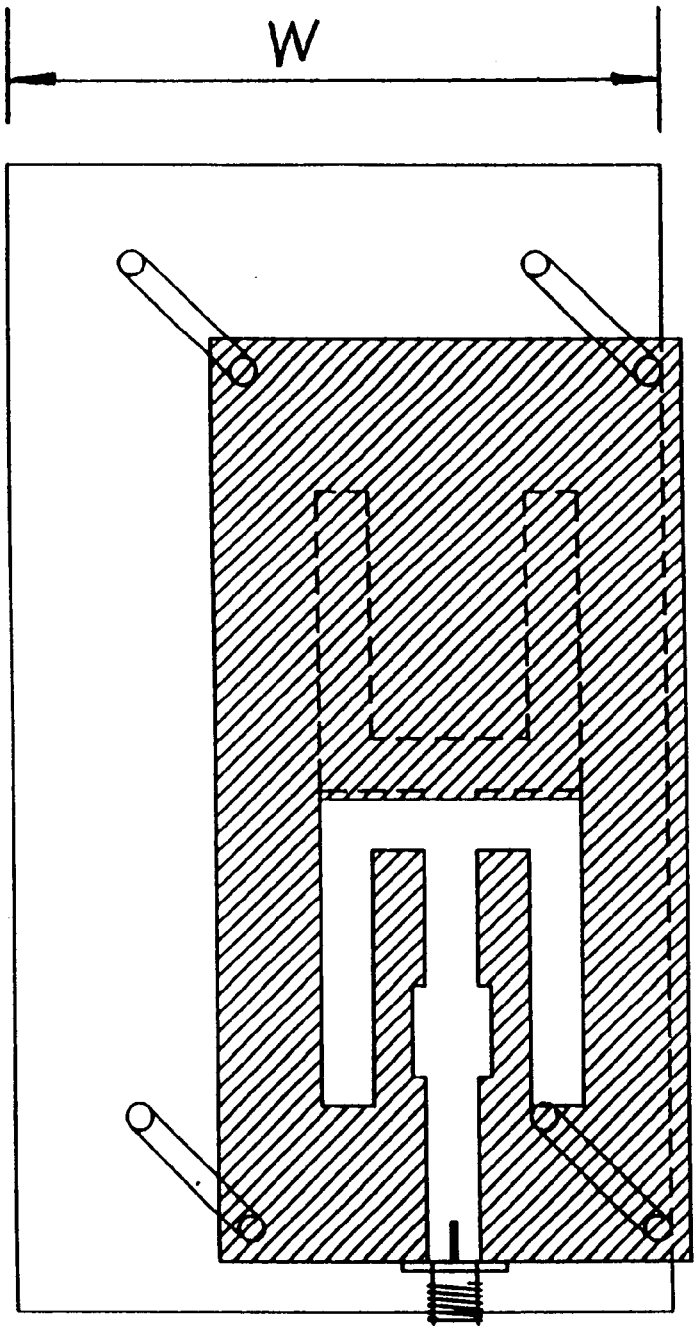
Figure 8:
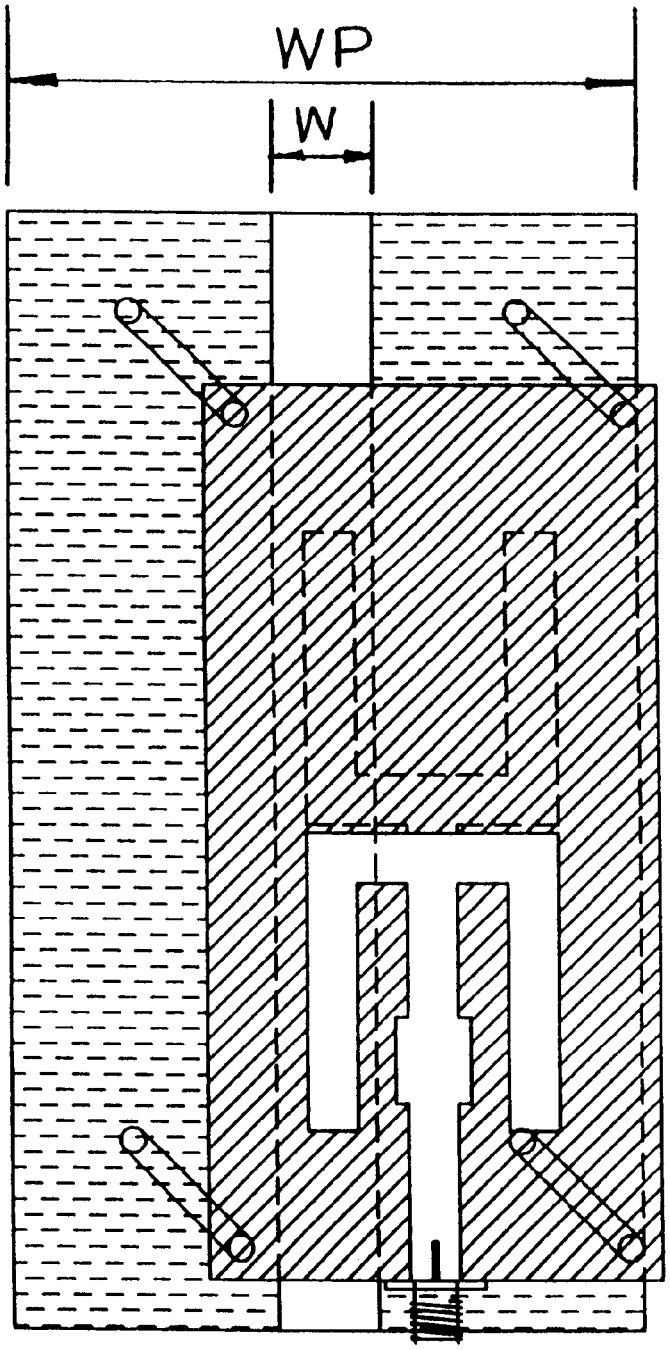
Figure 9A:
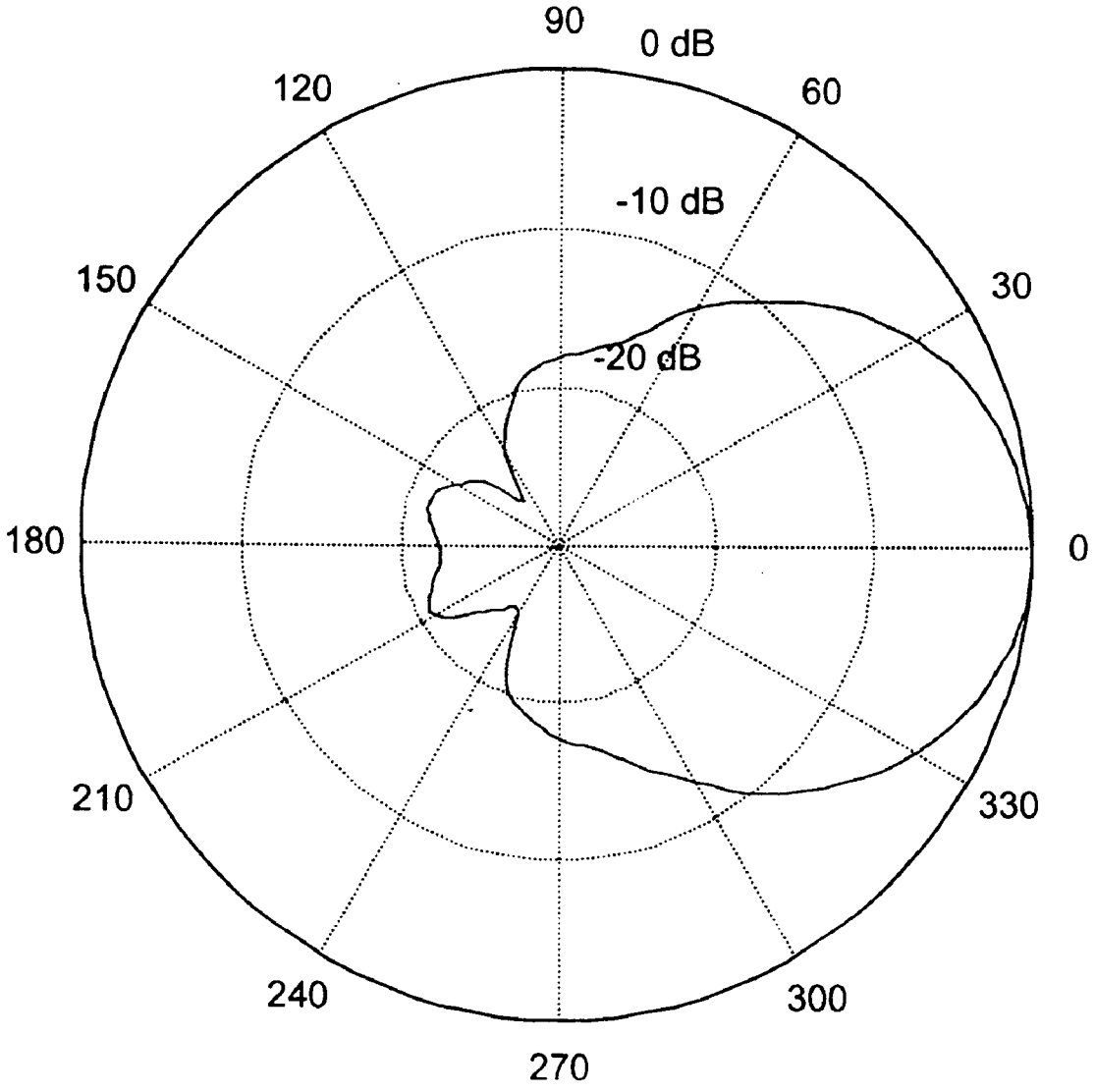
FIG. 9(*a*) to 9(*d*) are the respective four H-plane radiation patterns correspond to the antennas in FIG. 8(*a*) to 8(*d*) respectively to provide 55, 90, 120, and 180 degrees of horizontal beam widths, respectively.
Figure 9B:
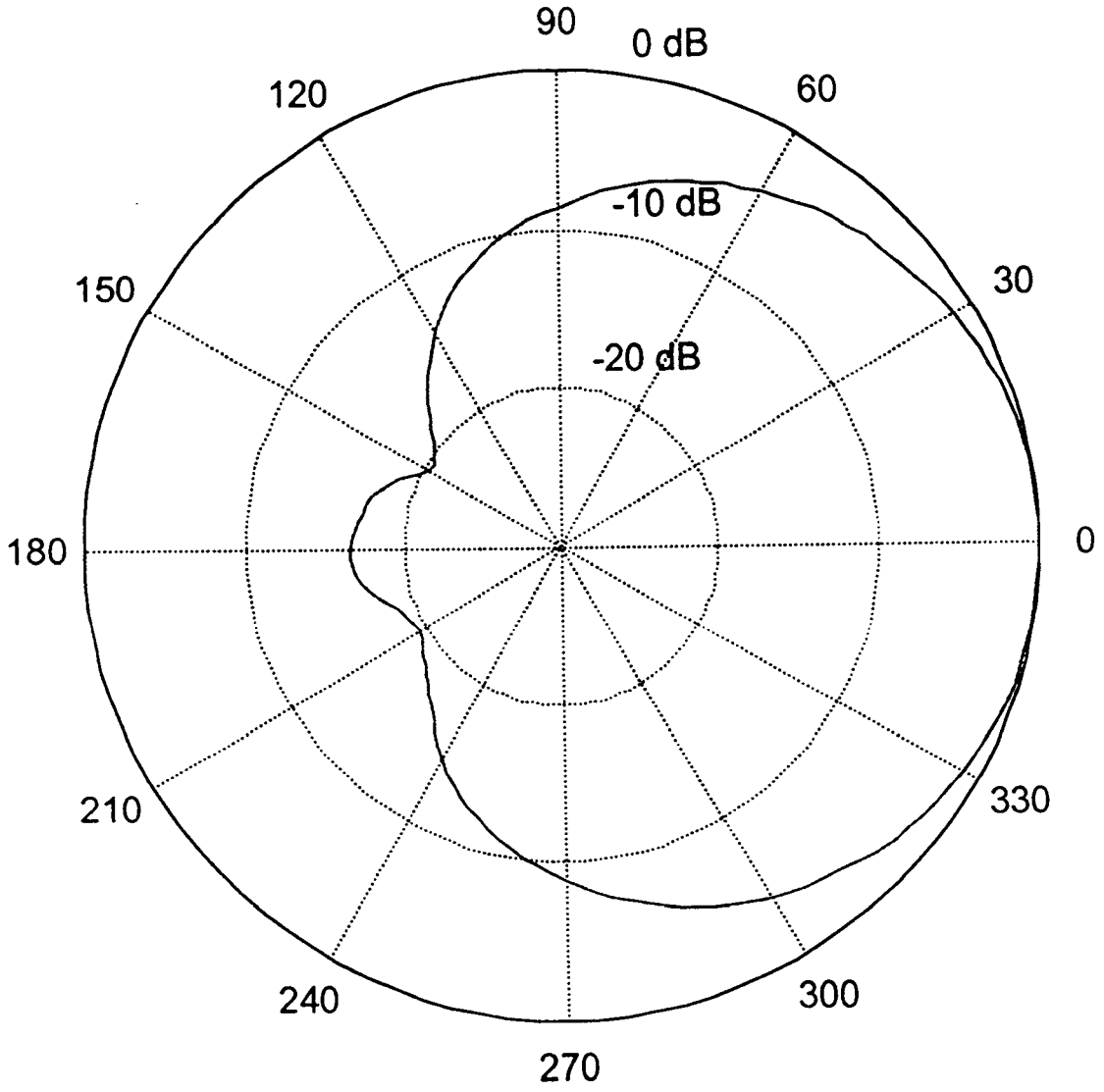
Figure 9C:
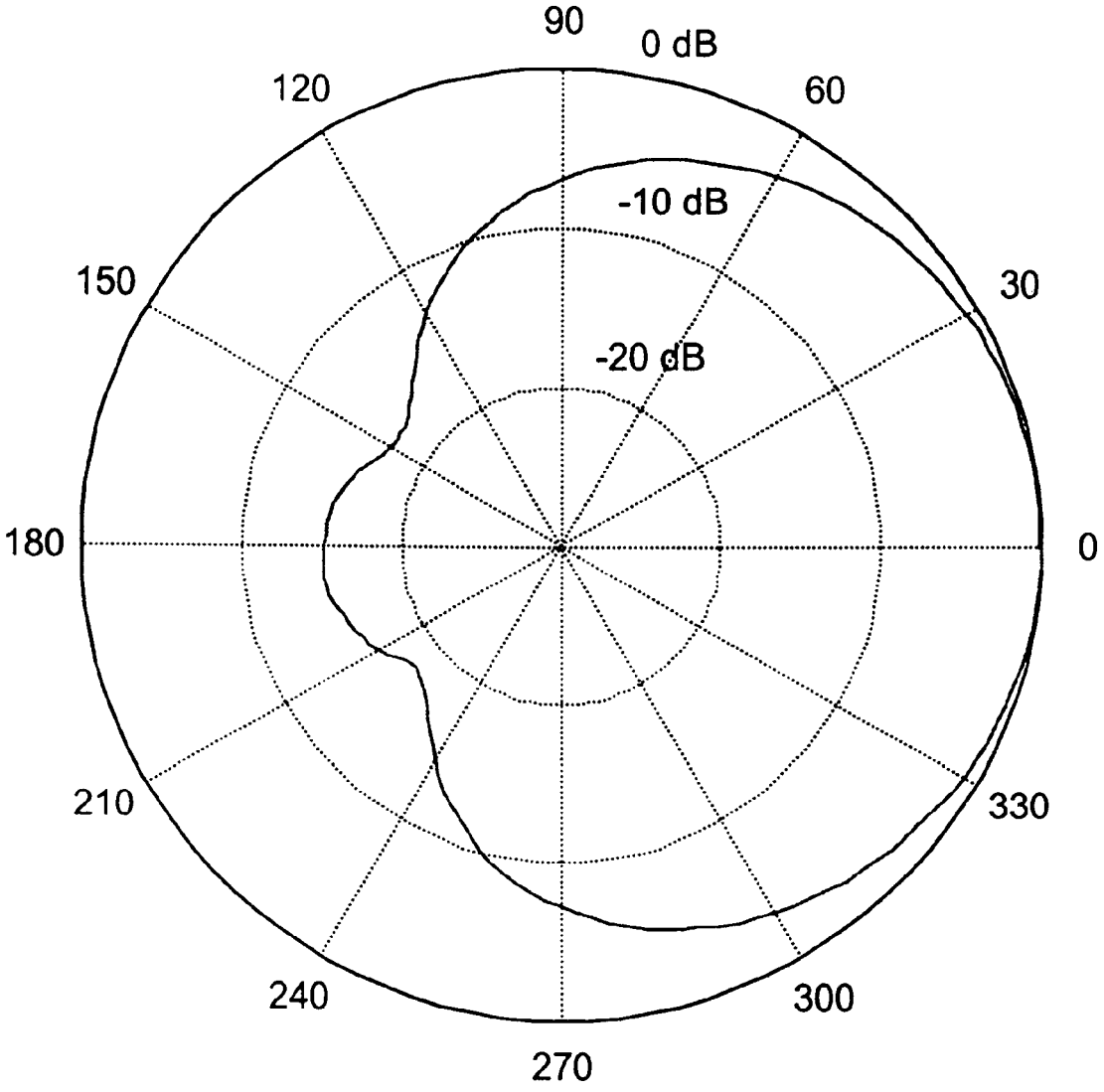
Figure 9D:
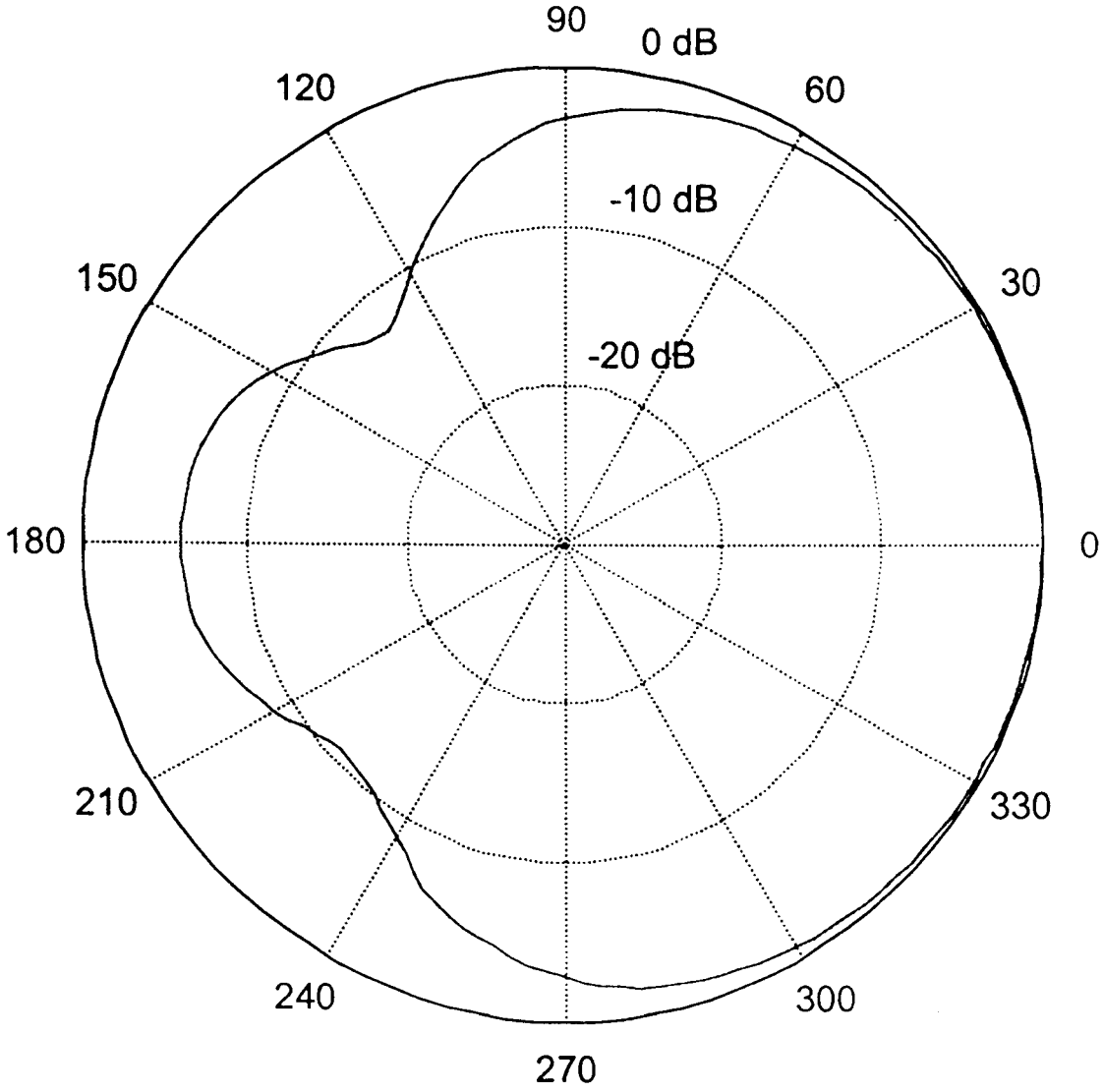

FIGS. 8(*a*) to 8(*d*) are the extended four embodiments of the dipole antenna based on FIG. 3 according to the present invention. The printed dipole antennas of the four embodiments are very similar, except the size of the matching patch (4) as shown in FIG. 1 and the size of the metal reflectors in FIGS. 8(*a*) to 8(*d*) can be slightly different.

A bent metal reflector as shown in FIG. 8(*a*) is properly designed and optimized with the width, W of the flat protion being equal to 70 mm and the width, B of the bent protions being equal to 30 mm. The reflector thus developed provides proper electromagnetic reflection of the printed dipole antenna to achieve higher gain with narrow horizontal beamwidth of about 55 degrees. The radiation pattern in H-plane is given in FIG. 9(*a*).

By properly design and optimize the width, W of the flat metal reflector as shown in FIG. 8(*b*), a desired 90 degree horizontal beamwidth is achieved with W=70 mm. The radiation pattern of this antenna in H-plane is given in FIG. 9 (*b*). The gain of this ante ma is a bit lower than the one in FIG. 8(*a*). However, it can be used to constitute an omni-directional radiation pattern if four of such antennas are combined together. Therefore, this antenna is also called a 90 degree sector antenna.

Further reducing the width, W of the flat metal reflector as shown in FIG. 8(*c*), a 120 degree horizontal beamwidth is obtained with W=50 mm. The radiation pattern in H-plane is given in FIG. 9(*c*). The gain of this antenna is even lower that that of the 90 degree sector ante ma, but it provides even width horizontal coverage for two way communications.

Since this antenna has 120 degree beamwidth, it can also be used to constitute an omni-directional radiation pattern if three of such antennas are combined together. Therefore, this antenna can also be called a 120 degree sector antenna.

Finally, a Printed Circuit Board (PCB) of FR4 material is used as shown in FIG. 8(*d*), it, which the width, WP of the flat PCB is the same as that of the flat metal reflector of the 120 degree sector antenna, i.e. WP=50 mm. However, the width, W of copper metal sheet as shown in FIG. 8(*d*) is used as a reflector. By properly optimizing the W, a 180 degree horizontal beamwidth is achieved, The radiation pattern of this antenna is given in FIG. 9(*d*). This antenna can also be called a 180 degree sector antenna.

As a summary, certain key technical figures of the four antennas described above is presented in the following table.

Directional Panel Antennas with Different Beamwidths

| Antenna shown in | Gain (dBi) | H-BW (Deg.) | V-BW (Deg.) | F/B (dB) |
|---|---|---|---|---|
| FIG. 8(a) | 9.5 | 55 | 60 | 22 |
| FIG. 8(b) | 7.5 | 90 | 60 | 14 |
| FIG. 8(c) | 7.0 | 120 | 60 | 14 |
| FIG. 8(d) | 3.5 | 180 | 60 | 5.8 |

Thus, the printed dipole antenna shown in FIG. 1 and its extended forms, have the following advantages over the current commercially available antennas:

common-mode current on the 50 Ohm RF connector and the cable connected to it, so that no antenna performance degradation will occur, not sensitive to monitoring devices;

the printed dipole antenna is easily manufactured, very cost effective, and small in size;

requires low tolerance PCB;

the directional antenna shown in FIG. 3, which is the extended form of FIG. 1, (original about 70 degrees ) provides super high gain and wide beam width (over 90 degrees); and the two elements printed dipole antennas are constituted in series fashion to achieve high antenna gain.

The four elements printed antenna shown in FIG. 7, which is the further extended form of FIG. 3, provides even higher gain than that of tie two elements printed antenna by making use of a low loss semi-rigid cable and parallel center feed mechanism. The noval cable attachment as shown in FIG. 7(*b*) maintain good omni-directional radiation pattern and high gain.

The two elements printed antenna in series feed fashion of this invention can be easily extended to three and/or more elements printed antennas. However, it was found that three elements printed antenna in series feed has 1 dB more than that of two elements printed antenna and four elements printed antenna in series feed has only 0.5 dB over that of the three elements printed antenna, or 1.5 dB over that of the two elements printed antenna This is mainly due to the loss of the series feed network. The four elements printed antenna in parallel feed as shown in FIG. 7 overcomes this problem as described in above section. Therefore, it has higher gain (1dB higher) than the four elements printed antenna in series feed and is more desirable.

Careful designing and optimizing of the reflectors as shown in FIG. 8(*a*) to 8(*d*) provide several desirable horizontal beamwidths (55, 90, 120, and 180 degrees). The antenna with 55 degree beamwidth offers the highest antenna gain based on a single printed dipole. The other three sector antennas make it possible to combine them to provide omni-directional radiation pattern and space diversity for modern communication systems.

Figure 10:
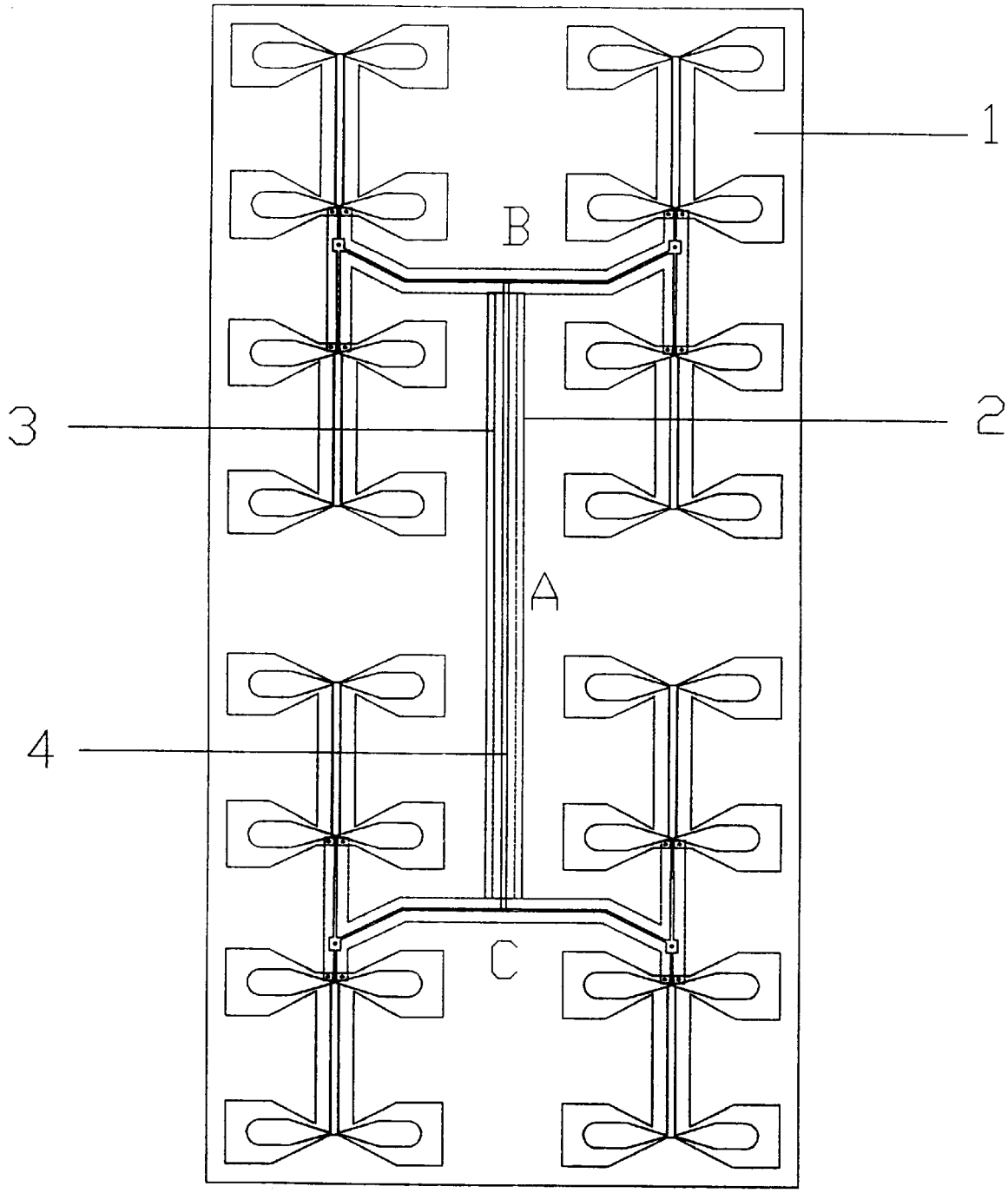
FIG. 10 is a plan view of an antenna array having a multiple of substrates.

Referring to FIG. 10, high gain panel antenna constructions having two different types of printed circuit boards for the feed network and radiation elements, respectively is shown.

A thirty two element antenna array is formed on a FR4 material (1)' is used as an example as shown in FIG. 7. A RF signal is fed from a center point A. Two microstrip lines, from the center feed point (A) to the feed points of top and bottom sub-arrays, (B) and (C), respectively, constitute a main feed network. Each microstrip line, made of FR4 material. Is about 160 mm long and has about 1.3 dB insertion loss, which is the major contributor to the loss of the total feed network. To solve this problem, an FR4 material (1)' was used for the whole antenna array and use low loss PCB material (2)' for the main feed network, consisting of the low loss PCB material (2)' , ground trace (3)' and signal trace (4)' although this slightly increases assembly complexity by cutting a slot in the FR4 material for the main feed network, preparing the main feed network with the low loss PCB material, and soldering (or connecting) the feed network to the points (B) and (C), respectively. However, it has been found that it is still much cheaper than using the low loss material for the whole antenna array. This is especially true when the array has a large number of elements to feed, and in which the size of the antenna correspondingly increases. Therefore, it can be seen that the antenna array is cost effective, but also keep its efficiency relatively high (i.e., higher gain). The measured antenna gain of thus implemented embodiment 1s 19.86 dBi, in comparison with 18.2 dBi of the similar antenna embodiment by using FR4 material only.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A printed dipole antenna comprising:

a) a dielectric member;

b) U-shaped radiating elements formed on respective sides of said dielectric member and in a non-overlapping arrangement;

c) a transmission line coupling a feed point to the radiating elements, such that a pair of radiating dipoles are formed by ones of the free arms of the U-shaped radiating element on respective sides of the dielectric member.

2. A printed dipole antenna as defined in claim 1, said transmission line and said free arm forming respective co-planar wave guides to thereby reduce common mode currents in said radiating elements.

3. A printed dipole antenna as defined in claim 1, wherein a base element of said U-shaped element has a small length such that said pair of dipoles appear as a single dipole from a far field.

4. A printed dipole antenna as defined in claim 1, including a metal reflector element arranged in a spaced relationship to one surface of said dielectric member.

5. A printed dipole antenna as defined in claim 4, said metal reflector being a planar metal reflector.

6. A printed dipole antenna as defined in claim 4, said metal reflector having edges extending at an angle to a planar surface of the metal reflector, said angle being determined in accordance with a desired beam width of said antenna.

7. A printed dipole antenna as defined in claim 1, said transmission line including patch elements for reducing voltage standing waves on the line.

8. A printed dipole antenna as defined in claim 1, having first and second pairs of U-shaped radiating elements being spaced along a plane of said dielectric member and coupled by a transmission line, whereby the pairs of elements are coupled in series.

9. A printed dipole antenna as defined in claim 8, including third and fourth pairs of U-shaped radiating elements, said elements being a mirror image of said first and second pairs of radiating elements.

10. A printed dipole antenna as defined in claim 9, said first and second pairs and said third and fourth pairs being coupled to a common central feed point.

11. A printed dipole antenna as defined in claim 1, said antenna being an end-feed antenna.

12. An antenna as defined in claim 8, said antenna being a center-feed antenna.

* * * * *